US008616684B2

(12) United States Patent
Miyazawa et al.

(10) Patent No.: US 8,616,684 B2
(45) Date of Patent: Dec. 31, 2013

(54) LIQUID-EJECTING HEAD, LIQUID-EJECTING APPARATUS, AND PIEZOELECTRIC ELEMENT

(75) Inventors: Hiromu Miyazawa, Azumino (JP); Ichiro Asaoka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 490 days.

(21) Appl. No.: 12/831,432

(22) Filed: Jul. 7, 2010

(65) Prior Publication Data

US 2011/0012963 A1 Jan. 20, 2011

(30) Foreign Application Priority Data

Jul. 16, 2009 (JP) ..... 2009-168194

(51) Int. Cl.
*B41J 2/045* (2006.01)

(52) U.S. Cl.
USPC ..... 347/71; 347/68; 347/72; 310/358

(58) Field of Classification Search
USPC ..... 347/68–72; 310/358; 252/62.9 PZ, 252/62.9 R
See application file for complete search history.

(56) References Cited

U.S. PATENT DOCUMENTS

2002/0189099 A1* 12/2002 Nishikawa ..... 29/890.1

FOREIGN PATENT DOCUMENTS

JP 2001-223404 8/2001

* cited by examiner

*Primary Examiner* — Henok Legesse
(74) *Attorney, Agent, or Firm* — Workman Nydegger

(57) ABSTRACT

A liquid-ejecting head includes a pressure-generating chamber that communicates with a nozzle opening and a piezoelectric element. The piezoelectric element includes a first electrode; a piezoelectric body layer formed on the first electrode; and a second electrode formed on the piezoelectric body layer on a side opposite the first electrode. In the liquid-ejecting head, the piezoelectric body layer has a perovskite structure and an insulating property, and an A-site and an oxygen site of the perovskite structure respectively include a vacancy formed by losing an A-site metal and a vacancy formed by losing an oxygen atom, each of the vacancies including a hydrogen atom.

11 Claims, 6 Drawing Sheets

LIQUID-EJECTING HEAD, LIQUID-EJECTING APPARATUS, AND PIEZOELECTRIC ELEMENT

CROSS-REFERENCE TO RELATED APPLICATIONS

This application claims the benefit of priority to Japanese Patent Application No. 2009-168194 filed Jul. 16, 2009, the contents of which are hereby incorporated by reference in their entirety.

BACKGROUND

1. Technical Field

The present invention relates to a liquid-ejecting head that ejects a liquid from a nozzle opening; a liquid-ejecting apparatus; and a piezoelectric element including a first electrode, a piezoelectric layer, and a second electrode.

2. Related Art

Piezoelectric elements used for liquid-ejecting heads each include two electrodes and a piezoelectric layer composed of a piezoelectric material having an electromechanical transducing function such as a crystalline dielectric material, the piezoelectric layer being sandwiched between the two electrodes. Such piezoelectric elements are used as actuators that operate in a flexural vibration mode and are mounted in liquid-ejecting heads. Typical examples of the liquid-ejecting heads include ink jet recording heads including diaphragms that form portions of pressure-generating chambers communicatively connected to nozzle openings from which ink droplets are ejected. The diaphragms are distorted with piezoelectric elements such that ink contained in the pressure-generating chambers is pressurized, whereby the ink is ejected from the nozzle openings as droplets. For example, the piezoelectric elements mounted in the ink jet recording heads are produced so as to independently correspond to pressure-generating chambers by uniformly forming a piezoelectric material layer over the entire surface of the diaphragms using a film formation technique and cutting the piezoelectric material layer into sections having a shape corresponding to that of the pressure-generating chambers by lithography.

A metal oxide having a perovskite structure such as lead zirconate titanate (PZT) is used as a piezoelectric material for such piezoelectric elements (refer to JP-A-2001-223404).

However, when a high voltage is applied to such piezoelectric elements, current leakage is sometimes caused. The current leakage poses a problem in that piezoelectric elements are heated and broken and thus degraded. Such a problem is seen in not only ink jet recording heads but also liquid-ejecting heads that eject a liquid other than ink. Furthermore, the problem is seen in not only piezoelectric elements used for the liquid-ejecting heads but also piezoelectric elements used for other devices.

SUMMARY

An advantage of some aspects of the invention is that a piezoelectric element that can improve an insulating property and suppress occurrence of current leakage, a liquid-ejecting head including the piezoelectric element, and a liquid-ejecting apparatus are provided.

In an aspect of the invention, a liquid-ejecting head includes a pressure-generating chamber that communicates with a nozzle opening; and a piezoelectric element including a first electrode, a piezoelectric body layer formed on the first electrode, and a second electrode formed on the piezoelectric body layer on a side opposite the first electrode. In the liquid-ejecting head, the piezoelectric body layer has a perovskite structure and an insulating property, and an A-site and an oxygen site of the perovskite structure respectively include a vacancy formed by losing an A-site metal and a vacancy formed by losing an oxygen atom, each of the vacancies including a hydrogen atom.

In this aspect, the piezoelectric body layer has a perovskite structure that includes vacancies formed by losing an A-site metal and an oxygen atom, the vacancies including a certain amount of hydrogen atoms, so as to achieve an insulating property. Since the piezoelectric body layer exhibits a good insulating property with a large band gap, the generation of leakage current can be suppressed.

The piezoelectric body layer preferably has a composition represented by the following formula (1). By providing hydrogen atoms in an amount twice the amount x of each of the A-site metal atoms lost and the oxygen atoms lost to the vacancies formed by losing the A-site metal atoms and the oxygen atoms, a piezoelectric body layer exhibiting a good insulating property with a large band gap can be obtained with certainty.

$$A_{1-x}BH_zO_{3-x} \quad (1)$$

($0<x\leq 0.01$ and $z=2x$).

It is preferable that the A-site of the piezoelectric body layer contains at least one metal selected from Pb, Ba, Sr, and Ca, and a B-site contains at least one metal selected from Zr, Ti, and Hf. Furthermore, it is more preferable that the A-site of the piezoelectric body layer mainly contains Pb and the B-site mainly contains Zr and Ti. Thus, a piezoelectric element having high displacement characteristics and Curie temperature is obtained.

The hydrogen atom is preferably bonded to the nearest oxygen atom located nearest to the hydrogen atom at a distance of 1.0±0.1 Å. In this case, since the energy state is stabilized and thus the hydrogen atom does not easily transition, a piezoelectric body layer stably having characteristics such as a piezoelectric constant is obtained.

The hydrogen atom is preferably present in each of a pair of vacancies formed by losing Pb of the A-site and formed by losing the oxygen atom of the oxygen site, the distance between Pb and the oxygen atom being 3.0 Å or less, and the hydrogen atom that is present in the vacancy formed by losing Pb of the A-site is preferably bonded to the nearest oxygen atom located nearest to the hydrogen atom that is present in the vacancy formed by losing Pb of the A-site at a distance of 1.0±0.1 Å. Since the energy state is stabilized and thus the hydrogen atom does not easily transition with such vacancies and a hydrogen atom, a piezoelectric body layer stably having characteristics such as a piezoelectric constant is obtained.

In another aspect of the invention, a liquid-ejecting head includes a pressure-generating chamber that communicates with a nozzle opening; and a piezoelectric element including a first electrode, a piezoelectric body layer formed on the first electrode, and a second electrode formed on the piezoelectric body layer on a side opposite the first electrode. In the liquid-ejecting head, the piezoelectric body layer has a perovskite structure, an A-site and an oxygen site of the perovskite structure respectively include a vacancy formed by losing an A-site metal and a vacancy formed by losing an oxygen atom, and the vacancies include hydrogen atoms in an amount twice the amount of the oxygen atom that has been lost. In this aspect, the piezoelectric body layer has a perovskite structure that includes vacancies formed by losing an A-site metal and an oxygen atom, the vacancies including a hydrogen atom in an amount twice the amount of the oxygen atom that has been lost. Thus, since the piezoelectric body layer exhibits a good insulating property with a large band gap, the generation of leakage current can be suppressed.

In still another aspect of the invention, a liquid-ejecting apparatus includes the liquid-ejecting head described above. In this aspect, since there is provided a liquid-ejecting head in which leakage current from a piezoelectric element is suppressed and dielectric breakdown is prevented, a liquid-ejecting apparatus with high reliability is obtained.

In still yet another aspect of the invention, a piezoelectric element includes a first electrode; a piezoelectric body layer formed on the first electrode; and a second electrode formed on the piezoelectric body layer on a side opposite the first electrode. In the piezoelectric element, the piezoelectric body layer has a perovskite structure and an insulating property, and an A-site and an oxygen site of the perovskite structure respectively include a vacancy formed by losing an A-site metal and a vacancy formed by losing an oxygen atom, each of the vacancies including a hydrogen atom. In this aspect, the piezoelectric body layer has a perovskite structure that includes vacancies formed by losing an A-site metal and an oxygen atom, the vacancies including a certain amount of hydrogen atoms, so as to achieve an insulating property. Since the piezoelectric body layer exhibits a good insulating property with a large band gap, the generation of leakage current can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
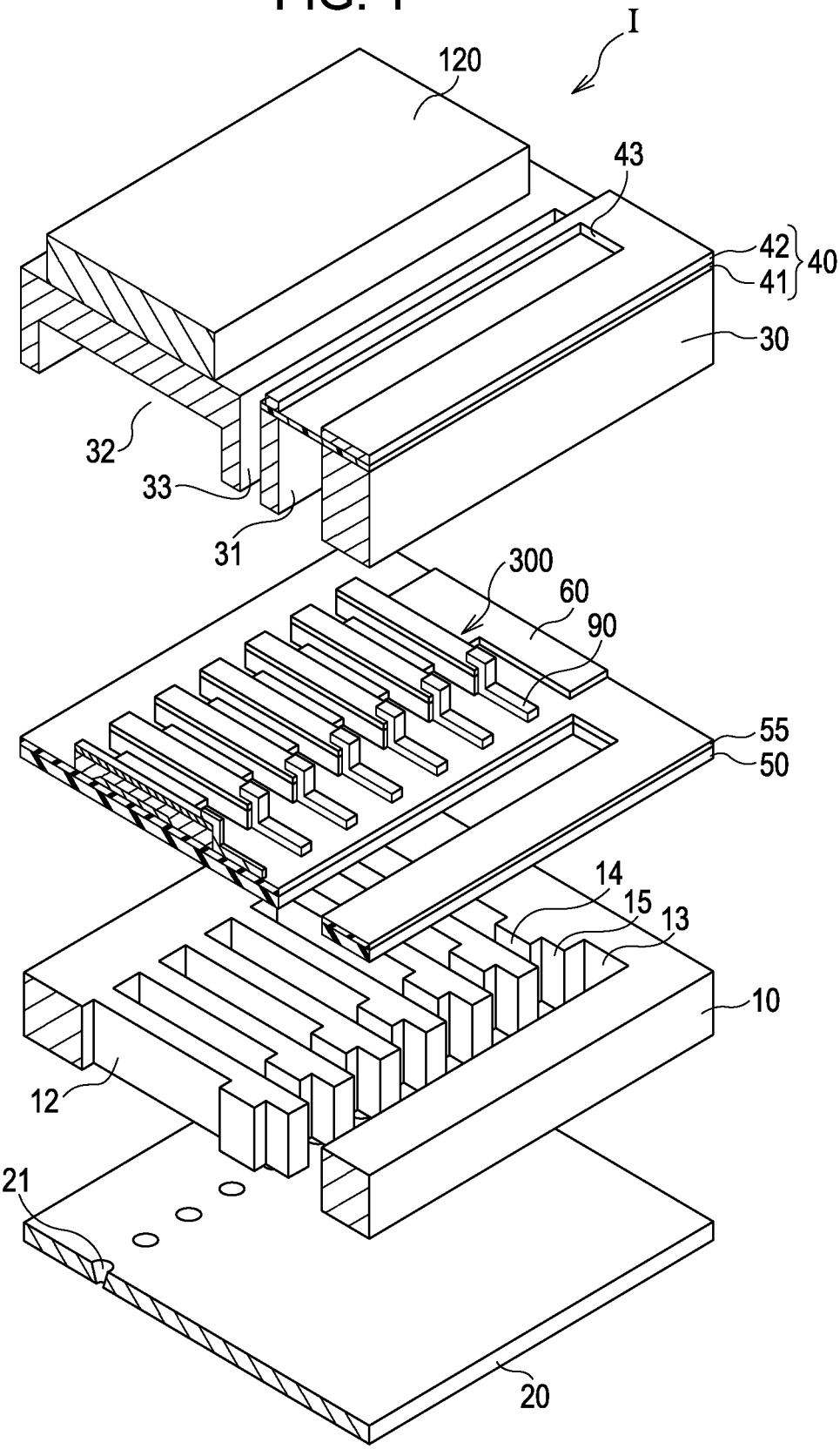
FIG. 1 is an exploded perspective view showing a schematic structure of a recording head according to a first embodiment.
Figure 2A:
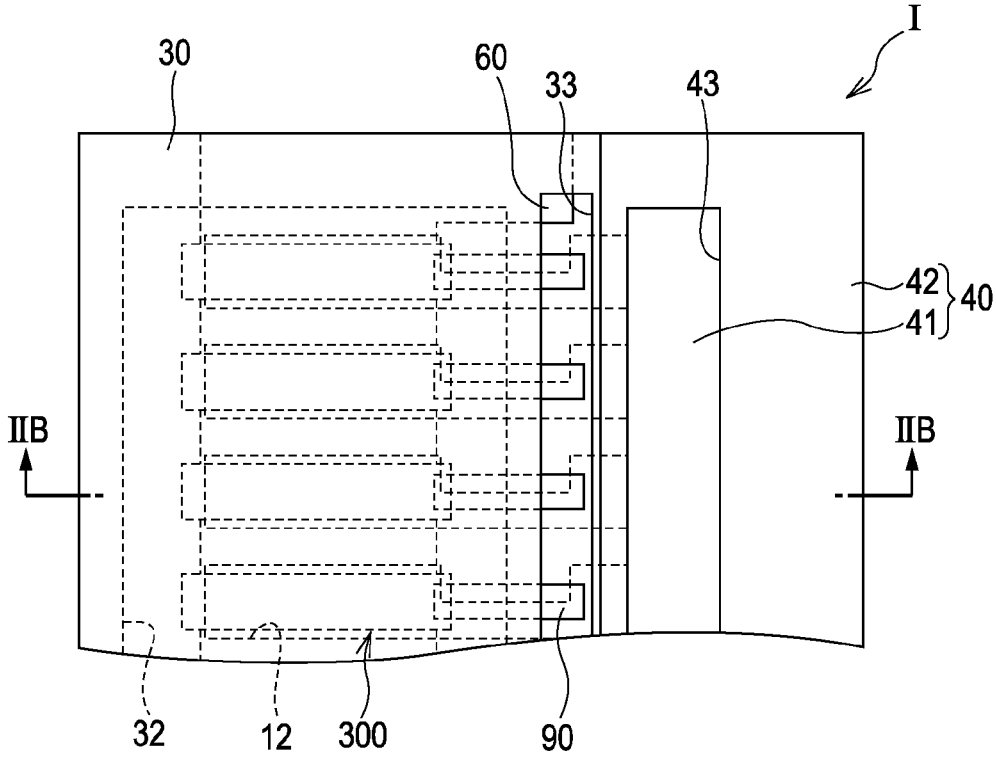
FIG. 2A is a plan view showing the recording head according to the first embodiment.
Figure 2B:
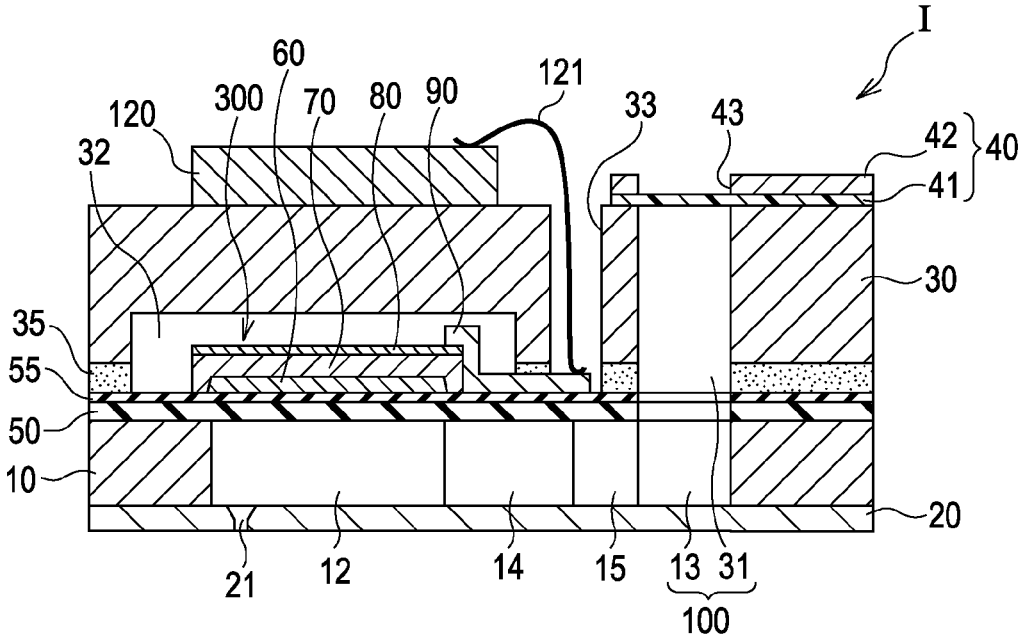
FIG. 2B is a sectional view showing the recording head according to the first embodiment.

FIG. 1 is an exploded perspective view showing a schematic structure of an ink jet recording head that is an example of a liquid-ejecting head according to a first embodiment of the invention. FIG. 2A is a plan view of FIG. 1 and FIG. 2B is a sectional view taken along line IIB-IIB.

As shown in the drawings, a flow path forming substrate 10 of this embodiment is composed of a silicon single crystal substrate. An elastic film 50 is formed on one surface of the flow path forming substrate 10.

In the flow path forming substrate 10, a plurality of pressure-generating chambers 12 are disposed side by side in the width direction thereof. A communicating portion 13 is formed in a region longitudinally outside the pressure generation chambers 12 of the flow path forming substrate 10. The communicating portion 13 communicates with each of the pressure-generating chambers 12 through an ink supply path 14 and a communicating path 15, which are provided for each of the pressure-generating chambers 12. The communicating portion 13 communicates with a reservoir portion 31 of a protective substrate described below, thereby constituting a portion of a reservoir 100 that serves as a common ink chamber for the pressure-generating chambers 12. The ink supply path 14 is formed at a width smaller than that of the pressure-generating chambers 12 and keeps the flow path resistance of ink constant, the ink flowing from the communicating portion 13 into the pressure-generating chambers 12. In this embodiment, the ink supply path 14 is formed by decreasing the width of the flow path from one side, but the ink supply path may be formed by decreasing the width of the flow path from both sides. Furthermore, the ink supply path may be formed by decreasing the flow path in a thickness direction instead of decreasing the width of the flow path. In this embodiment, the flow path forming substrate 10 includes the pressure-generating chambers 12, the communicating portion 13, the ink supply paths 14, and the communicating paths 15.

A nozzle plate 20 in which nozzle openings 21 each communicating with the end, of each of the pressure-generating chambers 12, opposite the ink supply path 14 side are formed is fixed on the opening surface side of the flow path forming substrate 10 using an adhesive, a hot-melt film, or the like. The nozzle plate 20 is composed of, for example, a glass ceramic, a silicon single crystal substrate, or stainless steel.

As described above, the elastic film 50 is formed on the side opposite the opening surface of the flow path forming substrate 10, and an insulating film 55 is formed on the elastic film 50. Furthermore, a first electrode 60, a piezoelectric body layer 70 having a thickness of, for example, 10 μm or less and preferably 0.3 to 1.5 μm, and a second electrode 80 are stacked on the insulating film 55, thereby constituting a piezoelectric element 300. Herein, the piezoelectric element 300 means a portion including the first electrode 60, the piezoelectric body layer 70, and the second electrode 80. In general, one of the electrodes of the piezoelectric element 300 is used as a common electrode, and the other of the electrodes and the piezoelectric body layer 70 are patterned so as to correspond to each of the pressure-generating chambers 12. In this embodiment, the first electrode 60 is used as a common electrode of the piezoelectric element 300 and the second electrode 80 is used as an individual electrode of the piezoelectric element 300. However, they may be replaced with each other for convenience of arrangement of a driving circuit and wiring lines. Herein, the piezoelectric element 300 and a diaphragm in which displacement occurs due to the driving of the piezoelectric element 300 are collectively called an actuator device. In the above-described example, the elastic film 50, the insulating film 55, and the first electrode 60 serve as the diaphragm, but the invention is obviously not limited to such a configuration. For example, without disposing the elastic film 50 and the insulating film 55, only the first electrode 60 may be caused to serve as the diaphragm. Alternatively, the piezoelectric element 300 itself may also practically serve as the diaphragm.

In the piezoelectric body layer 70 formed on the first electrode 60, a transition metal oxide crystal having a perovskite structure is preferentially oriented in a (100) direction. In the invention, the phrase "a crystal is preferentially oriented in a (100) direction" includes the case where all the crystal is oriented in a (100) direction and the case where most of the crystal (e.g., 90% or more) is oriented in a (100) direction. Furthermore, the piezoelectric body layer 70 preferably has an engineered domain configuration in which the polarization direction is inclined by certain degrees (50 to 60 degrees) with respect to the direction vertical to the film surface (the thickness direction of the piezoelectric body layer 70).

In the perovskite structure constituting the piezoelectric body layer 70, when a lattice constant in the direction vertical to the surface is assumed to be c and an in-plane lattice constant is assumed to be a, a>c is satisfied because of the tensile stress applied to the film surface. Therefore, the crystal structure of the piezoelectric body has monoclinic symmetry. In such a crystal structure of the piezoelectric body, high piezoelectricity can be achieved. This may be because, in such a structure, the polarization moment of the piezoelectric body easily rotates in response to an electric field applied in the direction vertical to the surface. In the piezoelectric body, the amount of change in the polarization moment and the amount of deformation in the crystal structure are directly linked with each other, which actually provides piezoelectricity. Thus, high piezoelectricity can be achieved in a structure in which polarization moment is easily changed.

In this embodiment, the piezoelectric body layer 70 is composed of a metal oxide having a perovskite structure and containing hydrogen. The A-site contains at least one metal selected from Pb, Ba, Sr, Ca, and the like and the B-site contains at least one metal selected from Zr, Ti, Hf, and the like. Furthermore, the A-site of the piezoelectric body layer 70 includes a vacancy formed by losing an A-site metal, and the oxygen site includes a vacancy formed by losing an oxygen atom. In a perovskite structure, twelve oxygen atoms coordinate to the A-site, and six oxygen atoms coordinate to the B-site and thus an octahedron is formed. A metal that is present in the A-site is called "A-site metal" and a metal that is present in the B-site is called "B-site metal". On the basis of the principal of charge neutrality, the deficient amount of A-site metal having an ionic valence of +2 is equal to the deficient amount of oxygen having an ionic valence of −2 and locating in the octahedron. The above-described metals such as Pb, Ba, Sr, and Ca each have an ionic valence of +2.

In the invention, the vacancy formed by losing the A-site metal and the vacancy formed by losing the oxygen atom include hydrogen atoms. In other words, at least part of the A-site metal atoms and the oxygen atoms is replaced with hydrogen atoms. By adjusting the amount of the replacement of the hydrogen atoms, an insulating property is imparted to the piezoelectric body layer 70. In this specification, the term "insulating property" means that leakage current generated when a voltage of 30 V is applied is $4\times10^{-5}$ A/cm$^2$ or less. The voltage of 30 V is a typical driving voltage applied to piezoelectric elements of ink jet heads.

Figure 8:
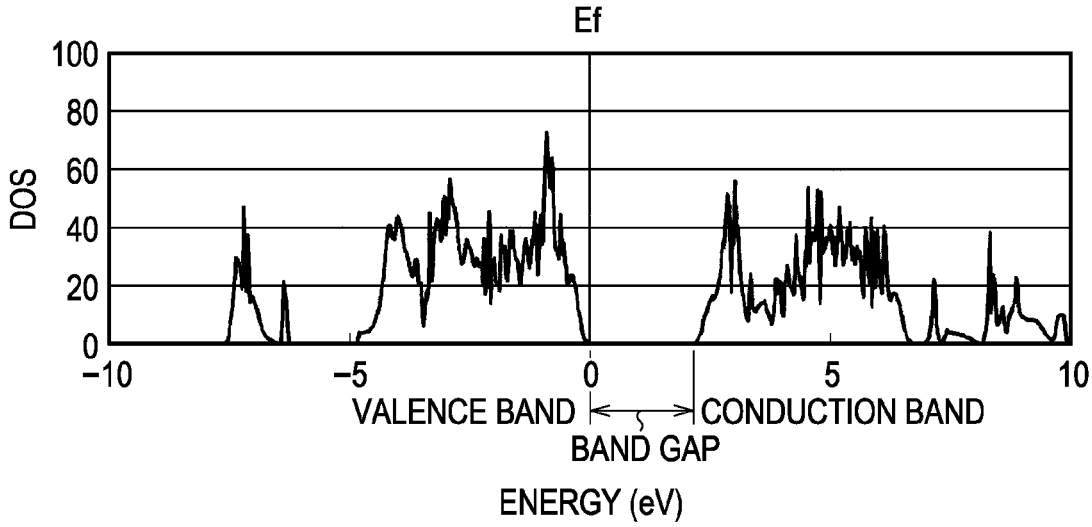
FIG. 8 shows density of states of PZT having vacancies formed by losing lead of the A-site and oxygen, the vacancies including two hydrogen atoms.

When hydrogen atoms are introduced into the metal oxide having a perovskite structure, the charge neutrality is normally lost and thus the insulating property disappears, which increases leakage current. However, as described in detail later, in the invention, the metal oxide exhibits a good insulating property with a large band gap as shown in FIG. 8 by providing a certain amount of hydrogen atoms to the vacancies of the A-site and the oxygen site.

Examples of the metal oxide having a perovskite structure in which the A-site contains at least one divalent metal selected from Pb, Ba, Sr, and Ca and the B-site contains at least one quadrivalent metal selected from Zr, Ti, and Hf include lead zirconate titanate ($Pb(Zr,Ti)O_3$), barium titanate, and strontium titanate. In the invention, vacancies are formed in the A-site and the oxygen site of the metal oxide and hydrogen atoms are introduced into the vacancies.

The piezoelectric body layer 70 preferably has a composition represented by the following formula (1). That is to say, the ratio of the amount of A-site metal lost to the amount of oxygen lost is 1:1 in terms of the number of atoms. Herein, z=2x means that hydrogen atoms are introduced in an amount twice the amount x of each of A-site metal atoms lost and oxygen atoms lost. As described above, the hydrogen atoms are present in the vacancies formed by losing the A-site metal atoms and the vacancies formed by losing the oxygen atoms.

$$A_{1-x}BH_zO_{3-x} \quad (1)$$

($0<x\leq0.01$ and $z=2x$)

The content of hydrogen can be measured with a secondary ion mass spectrometer (SIMS). The content of metal elements and the amounts of vacancies of the metal elements and oxygen atoms can be measured by inductively coupled plasma (ICP), X-ray induced photoelectron spectroscopy (XPS), or the like.

By providing hydrogen atoms in an amount twice the amount x of each of the A-site metal atoms lost and the oxygen atoms lost to the vacancies formed by losing the A-site metal atoms and the vacancies formed by losing the oxygen atoms, a piezoelectric body layer 70 having a good insulating property with a large band gap can be obtained. It is extremely difficult to make x zero due to arrangement entropy effects. That is, the free energy of the system is stabilized in the presence of lattice defects. If x is more than 0.01, the band gap cannot be sufficiently increased even if the amount of hydrogen atoms is adjusted. Thus, $0<x\leq0.01$ is preferred. When the ratio of the amount x of A-site metal lost to the amount x of oxygen lost is 1:1 in terms of the number of atoms, the sum of charges becomes zero because the A-site metal has an ionic valence of +2 and the oxygen atom has an ionic valence of −2. This satisfies "the mechanism of valence balance". Thus, the atomic defect conditions are satisfied in the piezoelectric thin film of this embodiment. The term "mechanism of valence balance" is also called "the mechanism of charge neutrality". In the mechanism, atoms in a crystal are constituted such that the sum of charges of ions in an ionic crystal is constantly zero overall.

Regarding the formula (1) described above, hydrogen atoms are not necessarily introduced in an amount twice the amount x of each of the A-site metal atoms lost and the oxygen atoms lost in the whole metal oxide crystal constituting the piezoelectric body layer 70. When z=2x is satisfied for most of the crystal, for example, 90% or more of the crystal constituting the piezoelectric body layer 70, advantages of the invention are obviously achieved. That is, even when about less than 10% of vacancies are left without hydrogen atoms, such a piezoelectric body layer 70 is included in the scope of the invention so long as the insulating property is within the range of the invention.

In the whole metal oxide crystal constituting the piezoelectric body layer 70, the ratio of the amount of A-site metal lost to the amount of oxygen lost is not necessarily 1:1 in terms of the number of atoms. The ratio needs to be 1:1 in most of the crystal, for example, in 90% or more of the crystal constituting the piezoelectric body layer 70.

Preferably, the A-site of the piezoelectric body layer 70 mainly contains Pb and the B-site mainly contains Zr and Ti. Since such a piezoelectric body layer 70 has high displacement characteristics and Curie temperature, a good piezoelectric element 300 is obtained. Examples of a material constituting the piezoelectric body layer 70 include lead zirconate titanate ($Pb(Zr,Ti)O_3$) and lead magnesium niobate zirconium titanate ($Pb(Zr,Ti)(Mg,Nb)O_3$).

The A-site of the piezoelectric body layer 70 mainly contains Pb and the B-site mainly contains Zr and Ti, and the B-site may further contain Pb. By providing Pb to not only the A-site but also the B-site, a large amount of displacement can be obtained with a low driving voltage, that is, a liquid-ejecting head having good ejection characteristics can be obtained.

A hydrogen atom is preferably bonded to the nearest oxygen atom located nearest to the hydrogen atom at a distance of 1.0±0.1 Å. When the distance between the hydrogen atom and the nearest oxygen atom is within the range described above, the structure is energetically stable compared with the case where a hydrogen atom is located at a position outside the range. Therefore, since the hydrogen atom does not easily transition and thus the energy state is stabilized, a piezoelectric body layer 70 stably having characteristics such as a piezoelectric constant is obtained.

Preferably, a hydrogen atom is present in each of a pair of vacancies formed by losing Pb of the A-site and formed by losing an oxygen atom of the oxygen site, the distance between Pb of the A-site and the oxygen atom being 3.0 Å or less, and the hydrogen atom that is present in the vacancy formed by losing Pb of the A-site is bonded to the nearest oxygen atom located nearest to the hydrogen atom that is present in the vacancy formed by losing Pb of the A-site at a distance of 1.0±0.1 Å. With such vacancies and hydrogen atom, the structure is energetically stable. Therefore, since the hydrogen atom does not easily transition and thus the energy state is stabilized, a piezoelectric body layer 70 stably having characteristics such as a piezoelectric constant is obtained.

A method for forming such a piezoelectric element 300 on the flow path forming substrate 10 is not particularly limited, and the manufacturing can be performed by, for example, the following method. First, a silicon dioxide film composed of silicon dioxide ($SiO_2$) or the like constituting an elastic film 50 is formed on a surface of a wafer for a flow path forming substrate, the wafer being a silicon wafer. An insulating film 55 composed of zirconium oxide or the like is then formed on the elastic film 50 (silicon dioxide film).

A first electrode 60 composed of platinum, iridium, or the like is formed on the entire surface of the insulating film 55 by sputtering and then patterned.

Subsequently, a piezoelectric body layer 70 is stacked. A method for forming the piezoelectric body layer 70 is not particularly limited. For example, the piezoelectric body layer 70 composed of a metal oxide can be formed by a so-called sol-gel method in which a sol obtained by dissolving or dispersing an organic metal compound in a solvent is applied and dried to produce a gel, and the gel is then fired at high temperature. The method for forming the piezoelectric body layer 70 is not limited to the sol-gel method, and a metal-organic decomposition (MOD) method or a gas phase method such as laser ablation or sputtering may be employed.

For example, first, a sol or an MOD solution (precursor solution) containing organic metal compounds including constituent metals of a piezoelectric material that later becomes the piezoelectric body layer 70 is applied to the first electrode 60 by spin coating or the like to form a piezoelectric body precursor film (application step).

The precursor solution applied is obtained by, for example, mixing organic metal compounds including constituent metals of a piezoelectric material that later becomes the piezoelectric body layer 70 such that the constituent metals have a desired molar ratio and dissolving or dispersing the mixture in an organic solvent such as an alcohol. For example, a metal alkoxide, an organic acid salt, or a β-diketone complex can be used as the organic metal compounds including constituent metals of the piezoelectric material. Specifically, an example of an organic metal compound including lead (Pb) includes lead acetate. Examples of an organic metal compound including zirconium (Zr) include zirconium acetylacetonate, zirconium tetraacetylacetonate, zirconium monoacetylacetonate, and zirconium bisacetylacetonate. Examples of an organic metal compound including titanium (Ti) include titanium alkoxide and titanium isopropoxide.

Some additives such as a stabilizer can be optionally added to the precursor solution. In the case where hydrolysis or polycondensation is performed on the precursor solution, an appropriate amount of water and an acid or a base as a catalyst can be added to the precursor solution. Examples of the additives to the precursor solution include diethanolamine and acetic acid. Furthermore, some additives for improving the characteristics of the piezoelectric body layer 70 can be added. For example, to prevent the occurrence of cracking, polyethylene glycol (PEG) or the like can be added.

The number of revolutions of spin during spin coating is set to, for example, about 500 rpm at the beginning, and the number of revolutions can be increased to about 2000 rpm to prevent the unevenness of application.

Subsequently, the piezoelectric body precursor film is dried by heating (drying step). For example, the heat treatment is performed in the air using a hot plate or the like at a temperature about 10° C. higher than the boiling point of the solvent used for the precursor solution.

The dried piezoelectric body precursor film is then heated to remove organic components contained in the piezoelectric body precursor film as forms of $NO_2$, $CO_2$, $H_2O$, and the like (degreasing step). For example, the heat treatment is performed at about 300 to 400° C. using a hot plate or the like.

Next, the piezoelectric body precursor film is crystallized by heating (firing step) to form the piezoelectric body layer 70. For example, the heat treatment can be performed in an oxygen atmosphere at about 650 to 800° C. by rapid thermal annealing (RTA) or the like.

After that, annealing at around 300° C. is preferably performed in a water vapor for about one minute. Through this step, the hydrogen concentration in the piezoelectric body layer can be controlled to an appropriate value.

By repeatedly performing the application step, drying step, and degreasing step described above or the application step, drying step, degreasing step, and the firing step described above multiple times to obtain a desired thickness or the like, a piezoelectric body layer composed of a plurality of piezoelectric body films may be formed.

Subsequently, post-annealing may be optionally performed at a temperature range of 600 to 700° C. As a result, favorable interfaces between the piezoelectric body layer 70 and the first electrode 60 and between the piezoelectric body layer 70 and a second electrode 80 can be formed, and the crystallinity of the piezoelectric body layer 70 can be improved.

After the piezoelectric body layer 70 is formed, a second electrode 80 composed of a metal such as Pt is stacked on the piezoelectric body layer 70, and the piezoelectric body layer 70 and the second electrode 80 are simultaneously patterned to form a piezoelectric element 300.

The presence or absence of the vacancies of the A-site and the oxygen site in the piezoelectric body layer 70, the amounts x of the A-site metal lost and the oxygen atom lost, the presence or absence of hydrogen atoms, the amount z of hydrogen atoms that are present, the positions of the hydrogen atoms, and the like vary in accordance with the manufacturing conditions in the step of forming the piezoelectric body layer 70, such as the composition of the precursor solution, the thickness of the piezoelectric body layer 70, degreasing temperature, firing temperature, and the water vapor atmosphere during the annealing. By adjusting these, the composition represented by the above-described formula (1) can be obtained. Specifically, when the degreasing temperature or the firing temperature is increased, the number of vacancies of the A-site and the oxygen site can be increased and the content of the hydrogen atoms can be decreased. When the degreasing temperature or the firing temperature is decreased, the number of vacancies of the A-site and the oxygen site can be decreased and the content of the hydrogen atoms can be increased. Furthermore, when the degreasing time or the firing time is increased, the number of vacancies of the A-site and the oxygen site can be increased and the content of the hydrogen atoms can be decreased. When the degreasing time or the firing time is decreased, the number of vacancies of the A-site and the oxygen site can be decreased and the content of the hydrogen atoms can be increased. Moreover, when the molecular weight or the additive amount of the compound having a hydrocarbon group such as PEG added to the precursor solution is increased, the content of the hydrogen atoms can be increased.

By the above-described manufacturing method, there can be provided a piezoelectric body layer 70 having an insulating property and whose A-site and oxygen site respectively include a vacancy formed by losing an A-site metal and a vacancy formed by losing an oxygen atom, each of the vacancies including a hydrogen atom.

The fact that the piezoelectric body layer 70 according to an aspect of the invention has a good insulating property will now be described with reference to FIGS. 3 to 9 by taking, as an example, a piezoelectric body layer 70 having a perovskite structure whose A-site metal is Pb and B-site metals are Zr and Ti and that includes hydrogen atoms. FIGS. 3 to 9 each show the electronic density of states (DOS) in the piezoelectric body layer 70, the electronic density of states being obtained using first principle electronic state calculation. The conditions of the first principle electronic state calculation were as follows. Ultra soft pseudopotential based on density functional theory within the range of generalized gradient approximation (GGA) was used. The cutoffs of a wave function and electron density were 20 hartree and 360 hartree, respectively. A supercell of the crystal used for the calculation was constituted by 2×2×2=8 $ABO_3$-type perovskite structures. The mesh of reciprocal lattice points (k points) was 4×4×4. The positions of the atoms were optimized such that the forces exerted on the atoms were minimized. Hereinafter, the horizontal axis shows the energy of electrons and the vertical axis shows the density of states (DOS). Fermi level Ef indicates a maximum energy level occupied by electrons in one-electron energy obtained through electronic state simulation.

Figure 3:
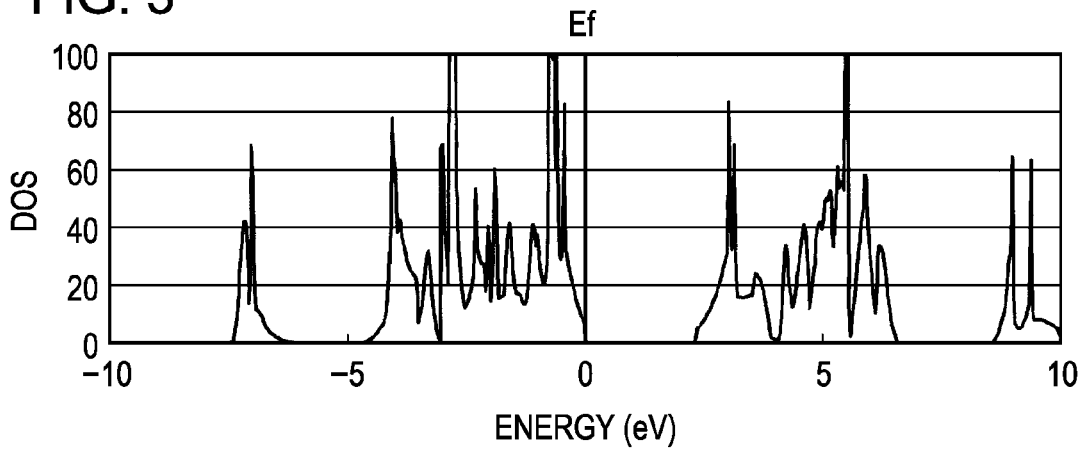
FIG. 3 shows density of states of PZT having no vacancy.

In the case where lead zirconate titanate (PZT) having a perovskite structure represented by $Pb(Zr_{0.5}Ti_{0.5})O_3$ does not include impurities such as hydrogen atoms and is a perfect crystal, that is, there are no vacancies in the sites, the piezoelectric body layer 70 has an insulating property because the Fermi level Ef lies at the top of a valence band as shown in FIG. 3. As shown in FIG. 3, the position of zero on the horizontal axis corresponds to the Fermi level. The band gap of such a piezoelectric body layer 70 is as large as 2.31 eV, and thus high piezoelectricity is maintained.

Figure 4:
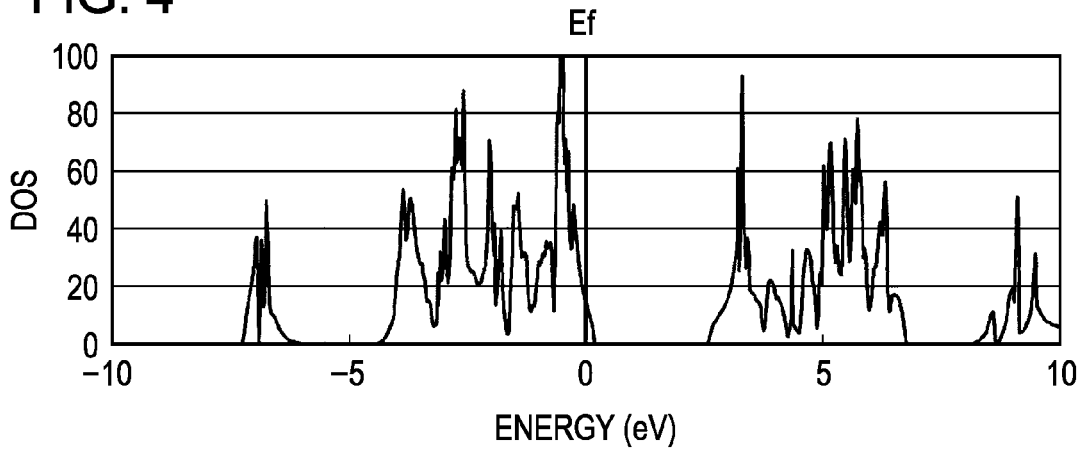
FIG. 4 shows density of states of PZT having a vacancy formed by losing lead of an A-site.

In the case where the piezoelectric body layer 70 is formed by, for example, the above-described sol-gel method or MOD method, part of Pb atoms, which are easily volatilized, is volatilized into the air or is diffused to the first electrode 60 side during the degreasing step or the firing step of the piezoelectric body layer 70 and is thus lost from the piezoelectric body layer 70. In particular, when the piezoelectric body layer 70 is a thin film having a thickness of 10 μm or less, this phenomenon in which Pb is lost appears remarkably. FIG. 4 shows the density of states of such a structure, that is, a structure in which Pb of the A-site is lost from the perfect crystal of PZT shown in FIG. 3 to form a vacancy. FIG. 4 shows the density of states of the piezoelectric body layer 70 composed of a crystal from which one Pb atom is lost with respect to a supercell. As shown in FIG. 4, since the Fermi level Ef lies within a valence band in the structure in which Pb of the A-site is lost from the perfect crystal of PZT shown in FIG. 3, the structure has no insulating property and serves as a p-type conductor. As the amount of Pb lost is increased, the conductivity is further increased.

Figure 5:
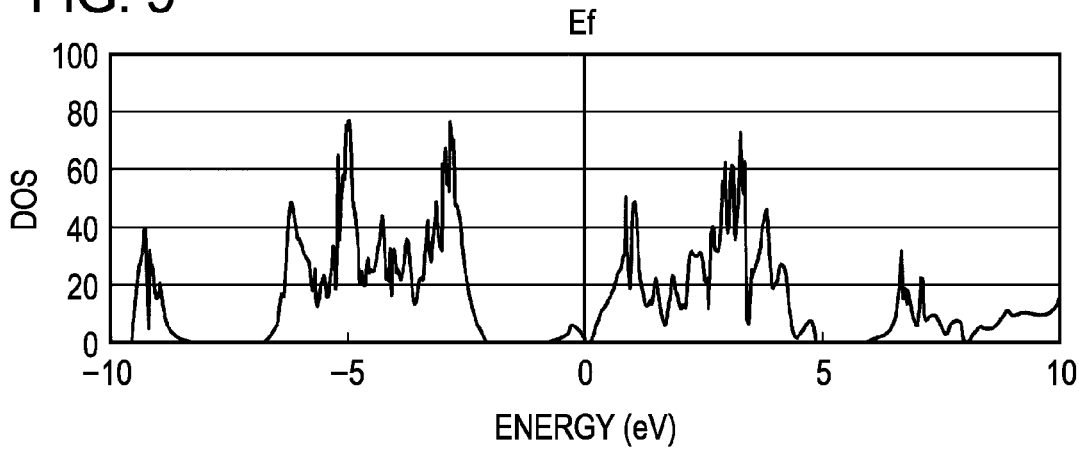
FIG. 5 shows density of states of PZT having a vacancy formed by losing oxygen.

FIG. 5 shows the density of states of a structure in which an oxygen atom of the oxygen site is lost from the perfect crystal of PZT shown in FIG. 3 to form a vacancy. FIG. 5 shows the density of states of the piezoelectric body layer 70 composed of a crystal from which one oxygen atom is lost with respect to a supercell. As shown in FIG. 5, since the Fermi level Ef lies within a conduction band in the structure in which an oxygen atom is lost from the perfect crystal of PZT shown in FIG. 3, the structure has no insulating property and serves as an n-type conductor. As the amount of the oxygen atom lost is increased, the conductivity is further increased.

Figure 6:
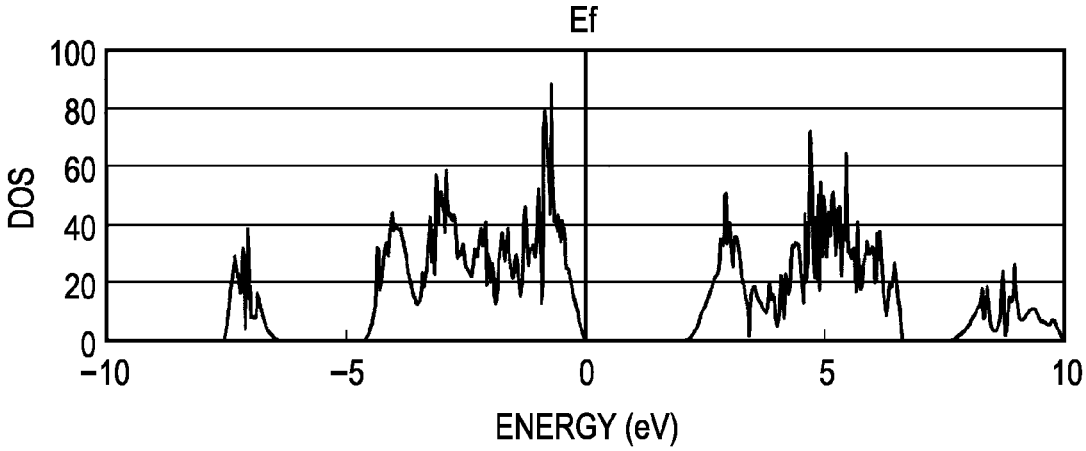
FIG. 6 shows density of states of PZT having vacancies formed by losing lead of the A-site and oxygen.

FIG. 6 shows the density of states of a structure in which Pb of the A-site is lost from the perfect crystal of PZT shown in FIG. 3 to form a vacancy and an oxygen atom of the oxygen site is lost from the perfect crystal to form a vacancy. Herein, the deficient amount of Pb is equal to that of oxygen. FIG. 6 shows the density of states of the piezoelectric body layer 70 composed of a crystal from which one Pb atom and one oxygen atom are lost with respect to a supercell. As shown in FIG. 6, since the Fermi level Ef lies at the top of a valance band in the structure in which Pb atoms and oxygen atoms are lost from the perfect crystal of PZT shown in FIG. 3 by the same number to form vacancies, the structure has an insulating property. However, the band gap is 2.04 eV, which is remarkably small compared with the perfect crystal having no vacancy. Thus, the structure is an insulator, but has a problem in that leakage current may be generated when a high voltage is applied.

FIG. 8 shows the density of states of a structure in which Pb of the A-site is lost from the perfect crystal of PZT shown in FIG. 3 to form a vacancy, an oxygen atom of the oxygen site is lost from the perfect crystal to form a vacancy, and a certain amount of hydrogen atoms are provided to the vacancies formed through such loss. FIG. 8 shows the density of states of the piezoelectric body layer 70 composed of a crystal from which one Pb atom and one oxygen atom are lost with respect to a supercell and in which one hydrogen atom is provided to each of the vacancies of the A-site and the oxygen site. As shown in FIG. 8, since the Fermi level Ef lies at the top of a valance band in the structure in which Pb atoms and oxygen atoms are lost from the perfect crystal of PZT shown in FIG.

3 to form vacancies and one hydrogen atom is provided to each of the vacancies, the structure has an insulating property. The band gap is 2.20 eV, which is sufficiently large, but is not as large as that of the perfect crystal (FIG. 3) having no vacancy. Thus, the structure has quite a good insulating property. Furthermore, from the calculation result of structure optimization, the hydrogen atom in the vacancy and the nearest oxygen atom form a pair, and the distance therebetween is 1.0 Å±0.1 Å. In other words, the hydrogen atom in the piezoelectric body layer 70 is present in the vacancy and forms a pair with the nearest oxygen atom.

Pb of the A-site and oxygen of the oxygen site are lost in a ratio of 1:1 in terms of the number of atoms to form vacancies, and one hydrogen atom is provided to each of the vacancies. That is, one Pb atom having an ionic valence of +2 and one oxygen atom having an ionic valence of −2 are lost whereas two hydrogen atoms having an ionic valence of +1 are introduced, whereby it is expected that the charge balance is disturbed and thus the structure serves as a conductor. However, the structure has an insulating property with a large band gap in reality as shown in FIG. 8.

As described above, by employing the structure of the invention that includes the vacancies formed by losing A-site metals and oxygen atoms of the perovskite structure and in which a certain amount of hydrogen atoms are provided to the vacancies, a piezoelectric body layer 70 having a good insulating property with a large band gap is obtained. Therefore, the generation of leakage current can be suppressed with certainty.

In the case where the total energy of the structure shown in FIG. 8, that is, the structure in which hydrogen atoms are present in the vacancies formed by losing A-site metals and oxygen atoms is zero, a structure in which hydrogen atoms are not present in the vacancies and are located at positions 2.0 Å away from the vacancies has an energy higher than that of the structure shown in FIG. 8 by 0.28 eV. Therefore, the hydrogen atoms provided are present in the energetically stable vacancies formed by losing A-site metals and oxygen atoms.

Figure 7:
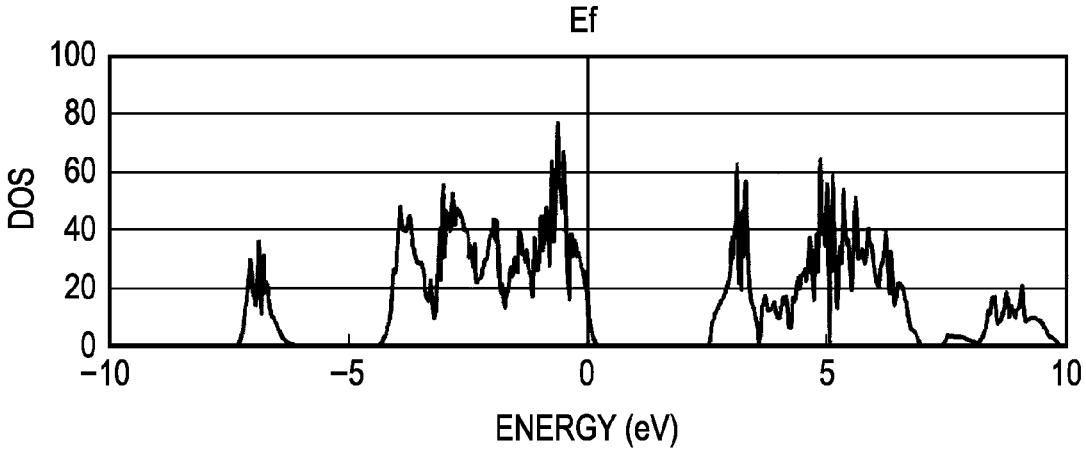
FIG. 7 shows density of states of PZT having vacancies formed by losing lead of the A-site and oxygen, the vacancies including one hydrogen atom.

Even if Pb atoms of the A-site and oxygen atoms of the oxygen site are lost from the perfect crystal of PZT shown in FIG. 3 to form vacancies and hydrogen atoms are provided to the vacancies formed through the loss, a crystal in which Pb and oxygen are lost in a ratio of 1:1 in terms of the number of atoms to form vacancies and only one hydrogen atom is provided to the pair of vacancies of the A-site and the oxygen site has no insulating property and serves as a conductor. FIG. 7 shows the density of states of the piezoelectric body layer 70 composed of a crystal from which one Pb atom and one oxygen atom are lost with respect to a supercell to form vacancies and in which one hydrogen atom is provided to only the vacancy of the A-site for the pair of vacancies of the A-site and the oxygen site. In FIG. 7, since the Fermi level Ef is within the valence band, the structure has no insulating property and serves as a p-type conductor.

Figure 9:
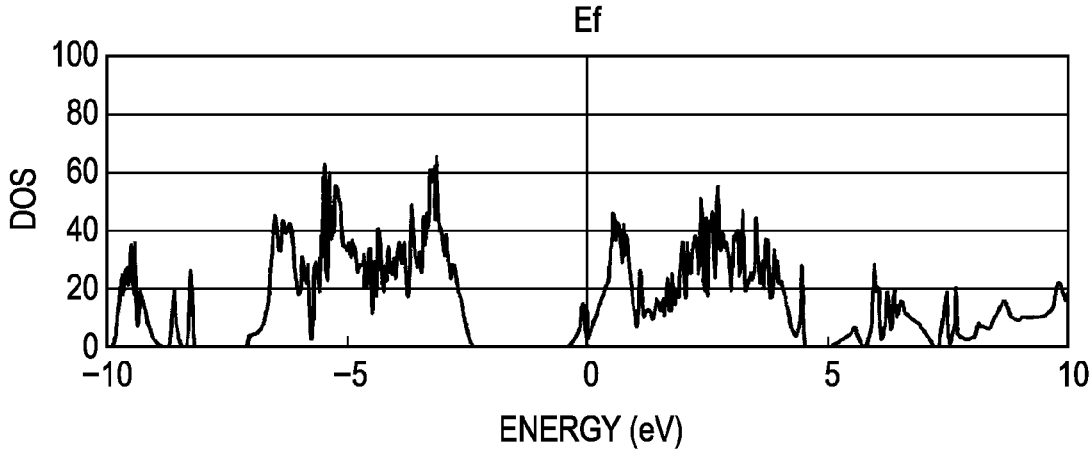
FIG. 9 shows density of states of PZT having vacancies formed by losing lead of the A-site and oxygen, the vacancies including three hydrogen atoms.

Even if Pb atoms of the A-site and oxygen atoms of the oxygen site are lost from the perfect crystal of PZT shown in FIG. 3 to form vacancies and hydrogen atoms are provided to the vacancies formed through the loss, a crystal in which Pb and oxygen are lost in a ratio of 1:1 in terms of the number of atoms to form vacancies and three or more hydrogen atoms are provided to the pair of vacancies of the A-site and the oxygen site has no insulating property and serves as a conductor. FIG. 9 shows the density of states of the piezoelectric body layer 70 composed of a crystal from which one Pb atom and one oxygen atom are lost with respect to a supercell to form vacancies and in which two hydrogen atoms are provided to the vacancy of the A-site and one hydrogen atom is provided to the vacancy of the oxygen site. In FIG. 9, since the Fermi level Ef is within the conduction band, the structure has no insulating property and serves as an n-type conductor.

The results of FIGS. 7 to 9 are summarized as follows. When one hydrogen atom or three or more hydrogen atoms are provided to a pair of vacancies of Pb and oxygen, the crystal serves as a conductor. However, when two hydrogen atoms are provided to the vacancies, the crystal serves as a good insulator.

In the above-described example, the case of $Pb(Zr_{0.5}Ti_{0.5})O_3$ has been described. Even if the composition ratio of each element is changed, the behaviors such as the position of Fermi level are the same. In addition, even if the type of element is changed, that is, even in a metal oxide having a perspective structure in which the A-site contains at least one metal selected from Pb, Ba, Sr, and Ca and the B-site contains at least one metal selected from Zr, Ti, and Hf, the behaviors such as the position of Fermi level are the same. Even if Pb is partly present in the B-site, a vacancy formed by losing Pb is formed in the A-site and the behaviors such as the position of Fermi level are the same.

Example

The manufacturing of a piezoelectric element 300 according to this embodiment will now be described in detail with an example.

(A) First, a $SiO_2$ layer was formed as an elastic film 50 on a surface of a flow path forming substrate 10 composed of a Si (110)-oriented substrate by Si thermal oxidation. The thickness of the elastic film 50 was 1000 nm.

(B) An insulating film 55 was formed on the elastic film 50. The insulating film 55 was a $ZrO_2$ film having a thickness of 500 nm and was formed by sputtering Zr and then performing thermal oxidation.

(C) A first electrode 60 was formed on the insulating film 55. The first electrode 60 was a film having a thickness of 200 nm and was formed by sputtering Pt and Ir in that order.

(D) A piezoelectric body layer 70 was formed on the first electrode 60. Specifically, lead acetate, zirconium acetylacetonate, titanium isopropoxide, and PEG were dissolved or dispersed in an alcohol such that Pb:Zr:Ti=1.15:0.5:0.5 (molar ratio) was satisfied, to prepare a precursor solution. The precursor solution was applied to the first electrode 60 with a thickness of 200 nm by spin coating (application step). After drying, heat treatment was performed at 350° C. (degreasing step). Subsequently, heat treatment was performed by RTA in an atmosphere containing 100% oxygen at 780° C. for 15 seconds (firing step). Annealing was then performed in water vapor at 300° C. for 45 seconds (water vapor annealing). By repeating a cycle of the application step, the degreasing step, the firing step, and the water vapor annealing three times, a piezoelectric body layer 70 having a thickness of 600 nm was obtained. In the formed piezoelectric body layer 70, a crystal was preferentially oriented in a (100) direction at an orientation ratio of 90% in a pseudocubic system. In X-ray diffraction, the rocking curve half width of a PZT (200) peak obtained by a θ-2θ method was 21 degrees. For the lattice constant of the piezoelectric body layer 70, when an in-plane lattice constant is assumed to be a and a lattice constant in the direction vertical to a film surface is assumed to be c, the lattice constant a was 4.18 Å and the lattice constant c was 4.15 Å. The piezoelectric body layer 70 was confirmed to have a monoclinic structure by Raman scattering, and had an engineered domain configuration in which the polarization direction is inclined by certain degrees with respect to the direction vertical to the film surface.

(E) A second electrode 80 composed of an Ir film having a thickness of 200 nm was formed on the piezoelectric body layer 70 by sputtering.

It was confirmed from X-ray diffraction that the thus-obtained piezoelectric body layer 70 had a perovskite structure. As a result of SIMS measurement, the content of hydrogen atoms of the obtained piezoelectric body layer 70 was 0.1%.

The leakage current in the piezoelectric body layer 70 when a voltage of 30 V was applied was $1\times10^{-5}$ A/cm$^2$, which means that the piezoelectric body layer 70 had a good insulating property.

As is clear from the results, a good insulating property and low leakage current can be achieved with a perovskite structure whose A-site and oxygen site respectively include a vacancy formed by losing an A-site metal and a vacancy formed by losing an oxygen atom, a certain amount of hydrogen atoms being provided to the vacancies.

The second electrode 80, which is an individual electrode of the piezoelectric element 300, is connected to the insulating film 55 through a lead electrode 90 composed of, for example, gold (Au), the lead electrode 90 being drawn from the end of the second electrode 80 on the ink supply path 14 side.

A protective substrate 30 including a reservoir portion 31 constituting at least a portion of a reservoir 100 is bonded, through an adhesive 35, on a flow path forming substrate 10 on which the piezoelectric element 300 has been formed, that is, on the first electrode 60, the insulating film 55, and the lead electrode 90. In this embodiment, the reservoir portion 31 penetrates the protective substrate 30 in the thickness direction and is formed so as to extend in the width direction of the pressure-generating chambers 12. The reservoir portion 31 communicates with a communicating portion 13 of the flow path forming substrate 10, thereby constituting the reservoir 100 that serves as a common ink chamber for the pressure-generating chambers 12. The communicating portion 13 of the flow path forming substrate 10 may be divided into a plurality of communicating portions 13 that correspond to the pressure-generating chambers 12 such that only the reservoir portion 31 serves as the reservoir 100. Furthermore, only the pressure-generating chambers 12 may be formed in the flow path forming substrate 10, and an ink supply path 14 connecting the reservoir 100 to the pressure-generating chambers 12 may be formed in a member (e.g., the elastic film 50 and the insulating film 55) that lies between the flow path forming substrate 10 and the protective substrate 30.

In a region of the protective substrate 30 that faces the piezoelectric element 300, a piezoelectric element holder 32 is formed so as to have a space with a size that does not interfere with the motion of the piezoelectric element 300. The piezoelectric element holder 32 needs only to have a space with the above-described size, and the space may be either sealed or not sealed.

The protective substrate 30 is preferably composed of a material having substantially the same coefficient of thermal expansion as that of the flow path forming substrate 10. Examples of the material include glass and ceramic materials. In this embodiment, the protective substrate 30 is formed using a silicon single crystal substrate, which is composed of the same material as that of the flow path forming substrate 10.

A through hole 33 penetrating the protective substrate 30 in the thickness direction is formed in the protective substrate 30. The end of the lead electrode 90 drawn from the piezoelectric element 300 is disposed so as to be exposed in the through hole 33.

A driving circuit 120 for driving the piezoelectric element 300 is fixed on the protective substrate 30. For example, a circuit substrate or a semiconductor integrated circuit (IC) can be used as the driving circuit 120. The driving circuit 120 and the lead electrode 90 are electrically connected to each other through a connecting wire 121 composed of a conductive wire such as a bonding wire.

Furthermore, a compliance substrate 40 composed of a sealing film 41 and a fixing plate 42 is attached to the protective substrate 30. The sealing film 41 is made of a material having flexibility and low stiffness, and one side of the reservoir portion 31 is sealed with this sealing film 41. The fixing plate 42 is made of a relatively hard material. Since the region of the fixing plate 42 that faces the reservoir 100 is an opening 43 formed by completely removing the fixing plate 42 in the thickness direction, one side of the reservoir 100 is sealed with only the sealing film 41 having flexibility.

In the ink jet recording head of this embodiment, ink is taken in from an ink inlet connected to an external ink supply unit (not shown) and the spaces from the reservoir 100 to the nozzle openings 21 are filled with the ink. Subsequently, a voltage is applied between the first electrode 60 and the second electrode 80 corresponding to each of the pressure-generating chambers 12 in accordance with a recording signal from the driving circuit 120 to distort the elastic film 50, the insulating film 55, the first electrode 60, and the piezoelectric body layer 70. Thus, the pressure inside the pressure-generating chambers 12 is increased and ink droplets are ejected from the nozzle openings 21.

Other Embodiments

An embodiment of the invention has been described, but the basic configuration of the invention is not limited to the above-described configuration. For example, in the piezoelectric body layer 70 of the above-described embodiment, a crystal is preferentially oriented in a (100) direction, but a crystal may be preferentially oriented in any direction.

In the above-described embodiment, a silicon single crystal substrate with a (110) crystal face direction has been exemplified as the flow path forming substrate 10, but the invention is not limited thereto. For example, a silicon single crystal substrate with a (100) crystal face direction may be used, and a silicon on insulator (SOI) substrate or a material such as glass may also be used.

In the above-described embodiment, the piezoelectric element 300 obtained by stacking the first electrode 60, the piezoelectric body layer 70, and the second electrode 80 on a substrate (flow path forming substrate 10) in that order has been exemplified, but the invention is not limited thereto. For example, the invention can be applied to a longitudinal vibration-type piezoelectric element in which a piezoelectric material and an electrode-forming material are alternately stacked such that the piezoelectric element is extendable in the axial direction.

Figure 10:
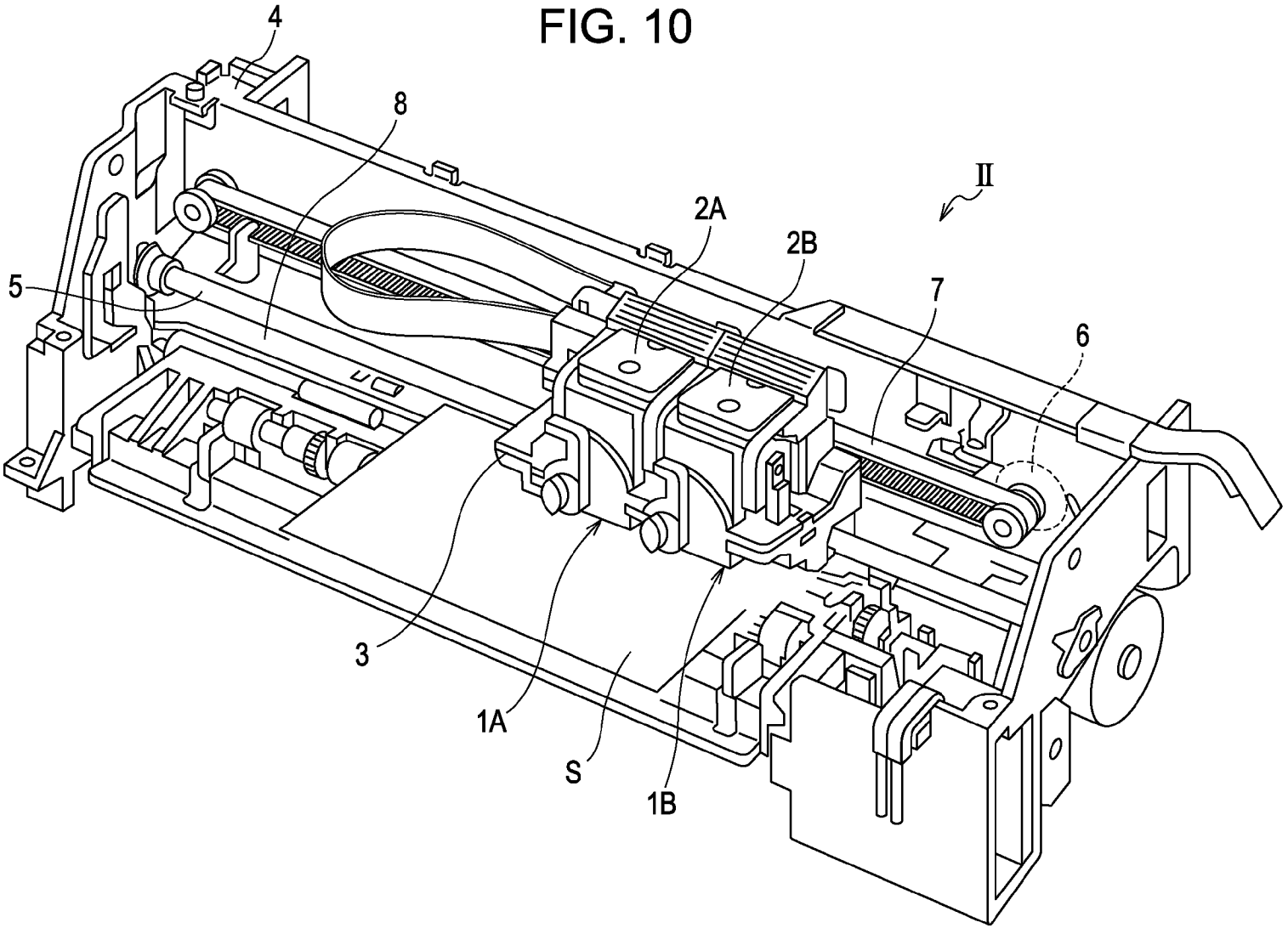
FIG. 10 shows a schematic structure of a recording apparatus according to an embodiment of the invention.

The ink jet recording heads of these embodiments are mounted on an ink jet recording apparatus by constituting a portion of a recording head unit including an ink flow path that communicates with an ink cartridge or the like. FIG. 10 is a schematic view showing an example of the ink jet recording apparatus.

In an ink jet recording apparatus II shown in FIG. 10, cartridges 2A and 2B constituting an ink supply unit are removably mounted on recording head units 1A and 1B each having an ink jet recording head I, respectively. A carriage 3 including the recording head units 1A and 1B is disposed on a carriage shaft 5 attached to an apparatus body 4 so as to be movable in the axial direction. For example, the recording head units 1A and 1B eject a black ink composition and a color ink composition, respectively.

A driving force of a driving motor 6 is transferred to the carriage 3 through a plurality of gears (not shown) and a timing belt 7, whereby the carriage 3 including the recording head units 1A and 1B are moved along the carriage shaft 5. A platen 8 is disposed on the apparatus body 4 in parallel with the carriage shaft 5. A recording sheet S, which is a recording medium such as paper that is fed by a paper feed roller (not shown), is wound around the platen 8 to be transported.

In the first embodiment, a description has been made using an ink jet recording head as an example of a liquid ejecting head. The invention is widely applied to general liquid ejecting heads and can also be applied to liquid ejecting heads that eject a liquid other than ink. Examples of the other liquid ejecting heads include various recording heads used in an image-recording apparatus such as a printer, colorant-ejecting heads used for producing a color filter of a liquid crystal display or the like, electrode material-ejecting heads used for forming an electrode of an organic electroluminescent (EL) display or a field emission display (FED), and biological organic substance-ejecting heads used for producing a biochip.

The invention is applied to not only piezoelectric elements mounted on liquid-ejecting heads represented by ink jet recording heads, but also piezoelectric elements mounted on other apparatuses such as a thin film capacitor.

What is claimed is:

1. A liquid-ejecting head comprising:
- a pressure-generating chamber that communicates with a nozzle opening; and
- a piezoelectric element including:
  - a first electrode;
  - a piezoelectric body layer formed on the first electrode, wherein:
    - the piezoelectric body layer has a perovskite structure and an insulating property, and
    - an A-site and an oxygen site of the perovskite structure respectively include a vacancy formed by losing an A-site metal and a vacancy formed by losing an oxygen atom, each of the vacancies including a hydrogen atom; and
  - a second electrode formed on the piezoelectric body layer on a side opposite the first electrode.

2. The liquid-ejecting head according to claim 1, wherein the piezoelectric body layer has a composition represented by the following formula (1):

$$A_{1-x}BH_zO_{3-x} \quad (1)$$

($0<x\leq 0.01$ and $z=2x$).

3. The liquid-ejecting head according to claim 1, wherein the A-site of the piezoelectric body layer contains at least one metal selected from Pb, Ba, Sr, and Ca, and a B-site contains at least one metal selected from Zr, Ti, and Hf.

4. The liquid-ejecting head according to claim 1, wherein the A-site of the piezoelectric body layer mainly contains Pb and a B-site mainly contains Zr and Ti.

5. The liquid-ejecting head according to claim 3, wherein the hydrogen atom is bonded to the nearest oxygen atom located nearest to the hydrogen atom at a distance of 1.0±0.1 Å. the A-site at a distance of 1.0±0.1 Å.

6. A liquid-ejecting apparatus comprising:
- a liquid-ejecting head including:
  - a pressure-generating chamber that communicates with a nozzle opening; and
  - a piezoelectric element including:
  - a first electrode;
  - a piezoelectric body layer formed on the first electrode, wherein:
    - the piezoelectric body layer has a perovskite structure and an insulating property, and
    - an A-site and an oxygen site of the perovskite structure respectively include a vacancy formed by losing an A-site metal and a vacancy formed by losing and oxygen atom, each of the vacancies including a hydrogen atom; and
  - a second electrode formed on the piezoelectric body layer on a side opposite the first electrode.

7. The liquid-ejecting apparatus according to claim 6, wherein the piezoelectric body layer has a composition represented by the following formula (1):

$$A_{1-x}BH_zO_{3-x} \quad (1)$$

($0<x\leq 0.01$ and $z=2x$).

8. The liquid-ejecting apparatus according to claim 6, wherein the A-site of the piezoelectric body layer contains at least one metal selected from Pb, Ba, Sr, and Ca, and a B-site contains at least one metal selected from Zr, Ti, and Hf.

9. The liquid-ejecting apparatus according to claim 6, wherein the A-site of the piezoelectric body layer mainly contains Pb and a B-site mainly contains Zr and Ti.

10. The liquid-ejecting apparatus according to claim 8, wherein the hydrogen atom is bonded to the nearest oxygen atom located nearest to the hydrogen atom at a distance of 1.0±0.1 Å.

11. A piezoelectric element comprising:
- a first electrode;
- a piezoelectric body layer formed on the first electrode, wherein:
  - the piezoelectric body layer has a perovskite structure and an insulating property; and
  - an A-site and an oxygen site of the perovskite structure respectively include a vacancy formed by losing an A-site metal and a vacancy formed by losing an oxygen atom, each of the vacancies including a hydrogen atom; and
- a second electrode formed on the piezoelectric body layer on a side opposite the first electrode.

* * * * *